US005090041A

United States Patent [19]

Furbee

[11] Patent Number: 5,090,041

[45] Date of Patent: Feb. 18, 1992

[54] X-RAY TUBE ANODE SPEED REDUCER

[75] Inventor: Avery D. Furbee, Elmhurst, Ill.

[73] Assignee: Picker International, Inc., Highland Hts., Ohio

[21] Appl. No.: 585,603

[22] Filed: Sep. 20, 1990

[51] Int. Cl.[5] ..... H05G 1/66

[52] U.S. Cl. ..... 378/93; 378/94; 318/269; 318/362

[58] Field of Search ..... 378/93, 94, 135, 131; 318/362, 365, 366, 367, 369, 374, 56, 63, 86, 269

[56] References Cited

U.S. PATENT DOCUMENTS 3,963,930 6/1976 Fiocca et al. ..... 378/94

*Primary Examiner*—Janice A. Howell
*Assistant Examiner*—Don Wong
*Attorney, Agent, or Firm*—Fay, Sharpe, Beall, Fagan, Minnich & McKee

[57] ABSTRACT

A rotor speed adjustment circuit (60) reduces the rotational speed of an anode (32) of an x-ray tube (14) in a diagnostic apparatus (10). An AC current (64) from an AC current source (54) is applied to one stator winding (52). A parallel connected diode (70) and resistor (72) are connected between the current source and a second stator winding (50) to cause an effective DC magnetic braking component (66*b*) which reduces the rotational speed of the anode and an associated rotor (42). By selectively adjusting the resistor (72), the size of the DC magnetic braking component, hence the amount of effective drag is selectively adjustable to adjust the anode rotation speed.

10 Claims, 4 Drawing Sheets

X-RAY TUBE ANODE SPEED REDUCER

BACKGROUND OF THE INVENTION

The present invention relates to the art of synchronous motor speed control. It finds particular application in conjunction with speed control circuits for rotating anode x-ray tubes and will be described with particular reference thereto. However, it is to be appreciated that the invention may find application in conjunction with other speed control circuits, particularly those in which the controlled motor has low efficiency.

Heretofore, rotating anode x-ray tubes have included a sealed and evacuated envelope in which the cathode, anode, anode bearings, anode rotor, and other associated structures were sealed. Stator windings were mounted outside of the envelope adjacent the rotor. In this manner, a synchronous motor, particularly a two-phase squirrel cage type of motor was created.

Commonly, these motors ran about one or two RPM slower than the frequency of the current applied to the stator. In countries, such as the United States, in which the line frequency is 60 Hz, the anode was rotated at about 58–59 RPM. Analogously, in Canada and countries that utilize a 50 Hz line frequency, the rotor was rotated at about 48–49 RPM.

One problem encountered with rotating anode x-ray tubes is that 4" rotors have a natural resonance frequency around 60 Hz and 5" anodes have a natural resonance frequency around 50 Hz. At the resonance frequency, the anodes tend to vibrate. Such vibration, of course, causes bearing wear and premature bearing failure. Perhaps more significantly, the vibrations of the anode cause corresponding fluctuations in the x-ray output of the tube. These x-ray fluctuations cause as "rotor ripple" artifacts in x-ray diagnostic images.

These x-ray fluctuations cause degradation in many x-ray tube applications. For example, in medical diagnostic imaging, these fluctuations in the x-ray intensity compromise the diagnostic value of the resultant diagnostic images.

One solution is to change the frequency of the line current applied to the stator windings. However, such frequency altering circuitry is relatively expensive.

In accordance with the present invention, a technique is provided for economically shifting the rotational speed of the rotating anode away from its resonant frequency.

SUMMARY OF THE INVENTION

In accordance with the present invention, a technique for altering the rotating speed of an anode is provided. Particularly, a DC magnetic brake component is cyclically applied to the stator.

More specifically to the preferred embodiment, a dissymmetry is created in the normal AC current supplied to one of the stator windings.

Still more specifically to the preferred embodiment, a parallel connected resistor and diode are connected in series between one of the stator windings and a source of AC current.

One advantage of the present invention is that it facilitates adjusting the rotational speed of x-ray tube anodes to move the anode rotation speed away from its resonance frequency.

Another advantage of the present invention is that it is relatively inexpensive.

Another advantage of the present invention is that it improves diagnostic x-ray images by reducing rotor ripple artifacts.

Still further advantages of the present invention will become apparent to those of ordinary skill in the art upon reading and understanding the following detailed description.

BRIEF DESCRIPTION OF THE DRAWINGS

The invention may take form in various components and arrangements of components and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
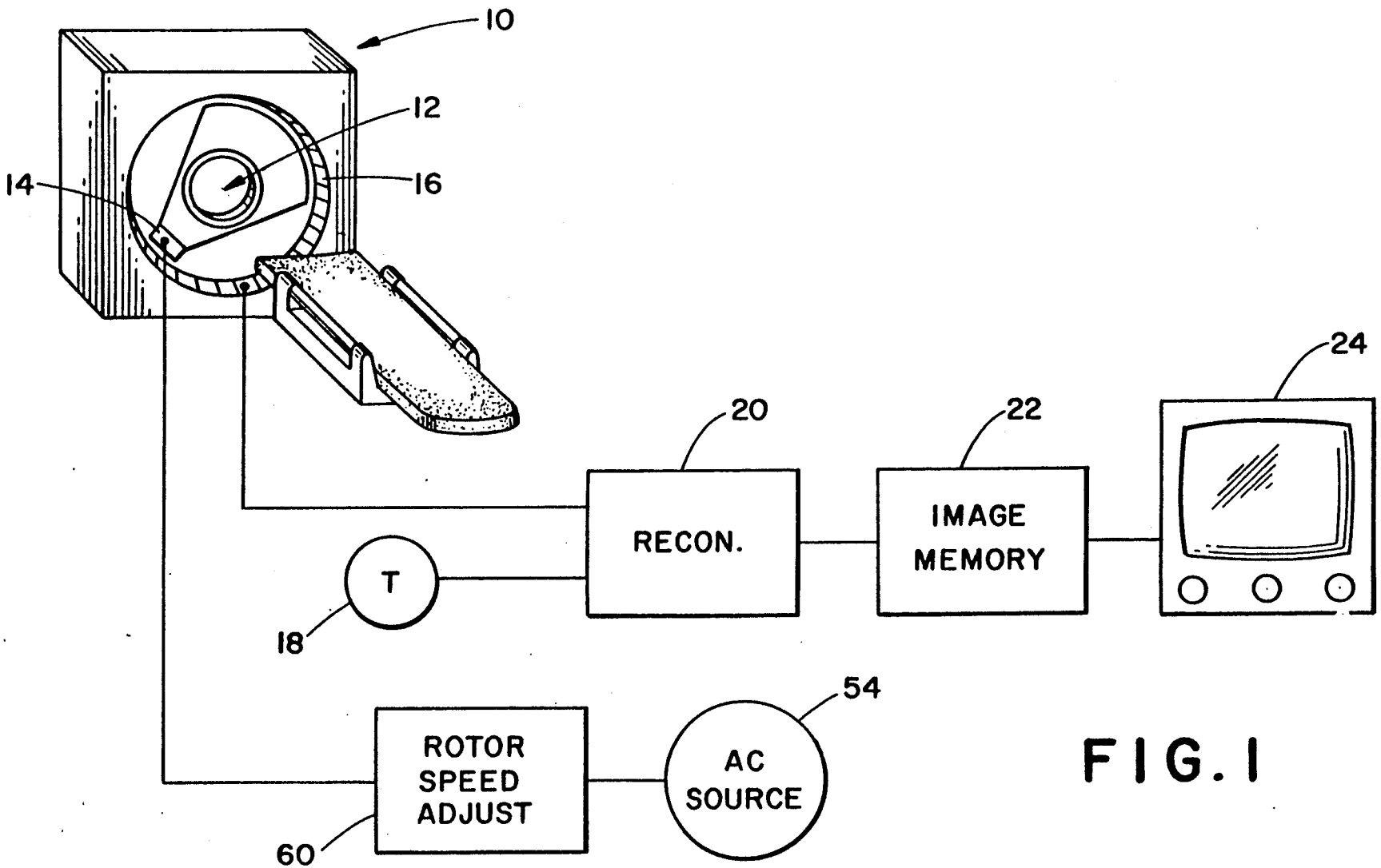
FIG. 1 is a diagrammatic illustration of an x-ray diagnostic system in accordance with the present invention.

With reference to FIG. 1, a medical diagnostic apparatus 10 examines a subject in an examination region 12 with x-rays. More specifically, an x-ray tube 14 projects radiation through the examination region 12 and onto an x-ray detecting means 16. Although the x-ray detecting means in the illustrated CT scanner embodiment converts x-rays into electrical signals, other x-ray detection means are contemplated. For example, the medical diagnostic apparatus can be one which produces projection or shadowgraphic images on x-ray sensitive photographic film. As another alternative, the x-ray diagnostic apparatus can be a digital x-ray system which generates shadowgraphic x-ray images in single or multiple energies electronically. Still other x-ray diagnostic apparatus is contemplated.

The x-ray detection means 16 and a means 18 for detecting rotation or angular position of the x-ray source 14 are connected with an image reconstruction means 20. The image reconstruction means utilizes conventional convolution and backprojection or other reconstruction algorithms as are known in the art. The reconstruction means produces an electronic image representation for storage in an image memory 22. A man readable display means 24, such as a video monitor, produces a diagnostic display of the reconstructed image.

Figure 2:
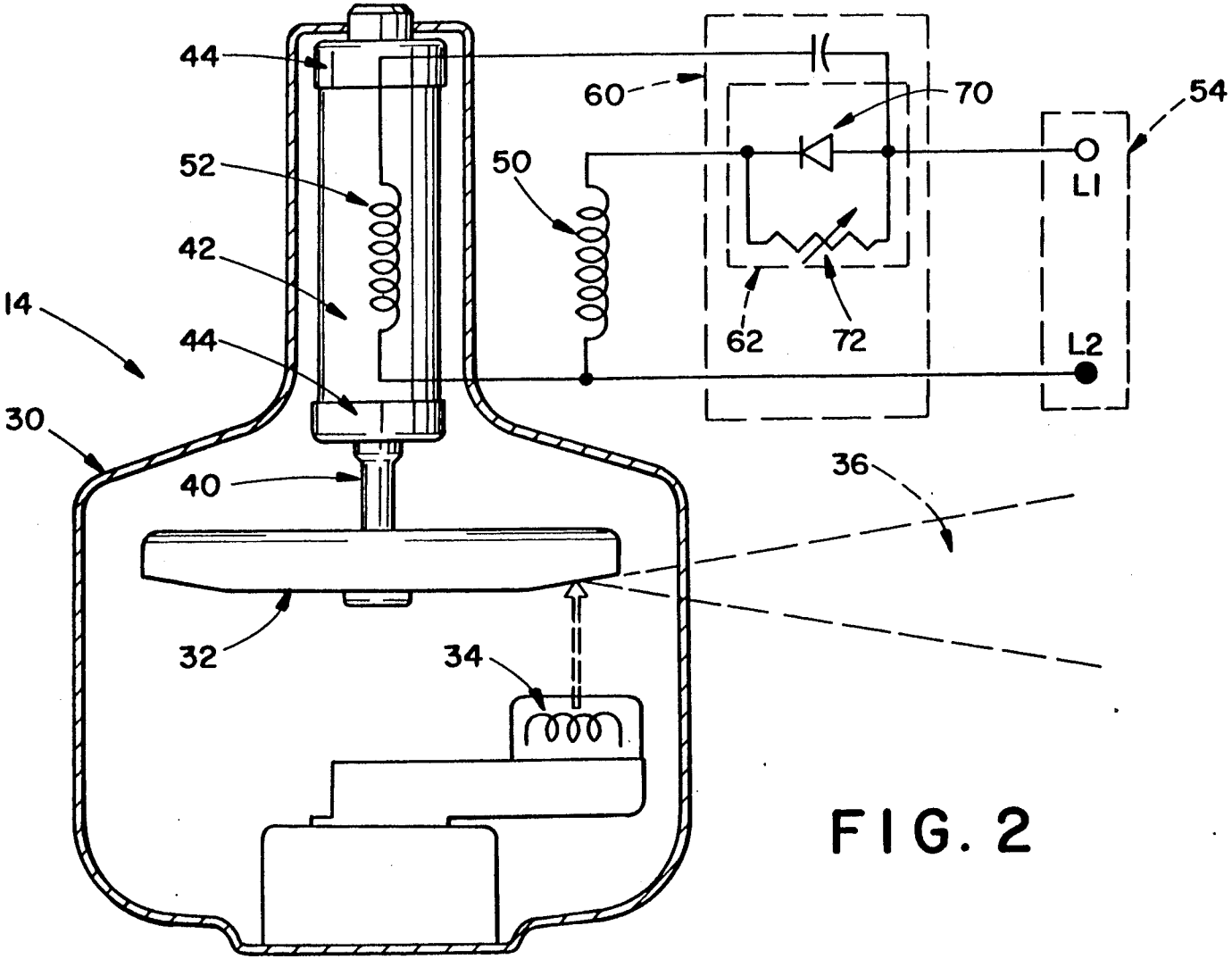
FIG. 2 illustrates a preferred speed altering circuit in accordance with the present invention.

With continued reference to FIG. 1 and further reference to FIG. 2, the x-ray tube 14 includes an evacuated envelope 30 in which an anode 32 is rotatably mounted. A beam of electrons selectively flows from a heated element cathode 34 to a focal spot on the rotating anode from which a beam 36 of x-rays emanates. The anode is connected to a shaft 40 which is connected to a rotor 42. The rotor 42 is mounted by bearings 44 in a neck portion of the evacuated envelope 3.

The rotor 42 is electromagnetically coupled with a main stator winding 50 and an auxiliary stator winding 52 on the outside of the evacuated envelope neck portion. The stator windings are interconnected with a source 54 of AC line current. With this arrangement, the rotor would inherently rotates at generally the oscillation frequency of the line current source. Bearing friction, inefficiencies in the electromagnetic transfer through the envelope 30, and the like generally cause the rotor speed to lag the AC line current frequency by a small amount, e.g. 2% or 3%.

Figure 3:
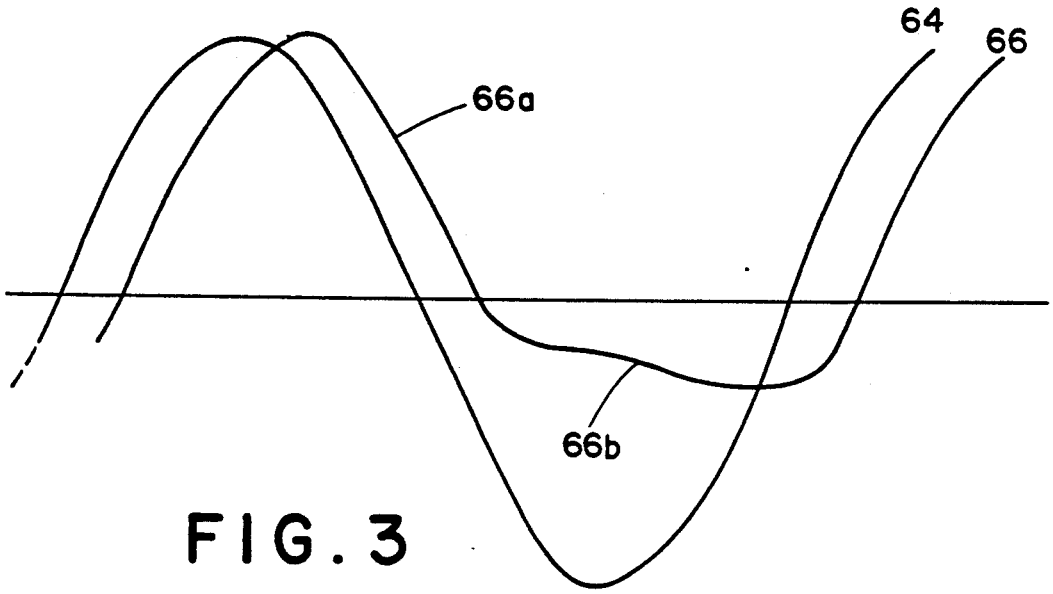
FIG. 3 illustrates the resultant currents applied to the stator windings by the circuit of FIG. 2.

A rotor speed adjusting circuit 60 adjusts the rotation speed or frequency of rotor rotation relative to the line frequency. More specifically, the speed adjusting circuit includes a means 62 for periodically applying a DC magnetic brake component to the stator. Specifically, the AC line current applied across auxiliary winding 52 has a generally sinusoidal wave form as illustrated in curve 64 of FIG. 3. The means 62 causes a dissymmetry in the normal AC line current as illustrated by curve 66 of FIG. 2.

In the preferred embodiment, the means 62 includes a parallel connected diode 70 an resistor 72. During half of the AC cycle, the positive half cycle with the illustrated orientation of the diode 70, the diode is conducting and the applied current at 66*a* is substantially a half sinusoid. On the opposite half cycle, the diode is nonconducting and the resistor becomes active reducing the current flow as illustrated by 66*b*. This results in a DC component of current and a consequent magnetic drag in the main winding 50 of the stator. The speed of the rotor is slowed in accordance with the amount of drag, which varies in accordance with the magnitude of the resistor 72. By selectively adjusting the resistor 72, the amount of drag, hence the amount of speed reduction of the anode and rotor, are selectively adjustable.

Figure 4:
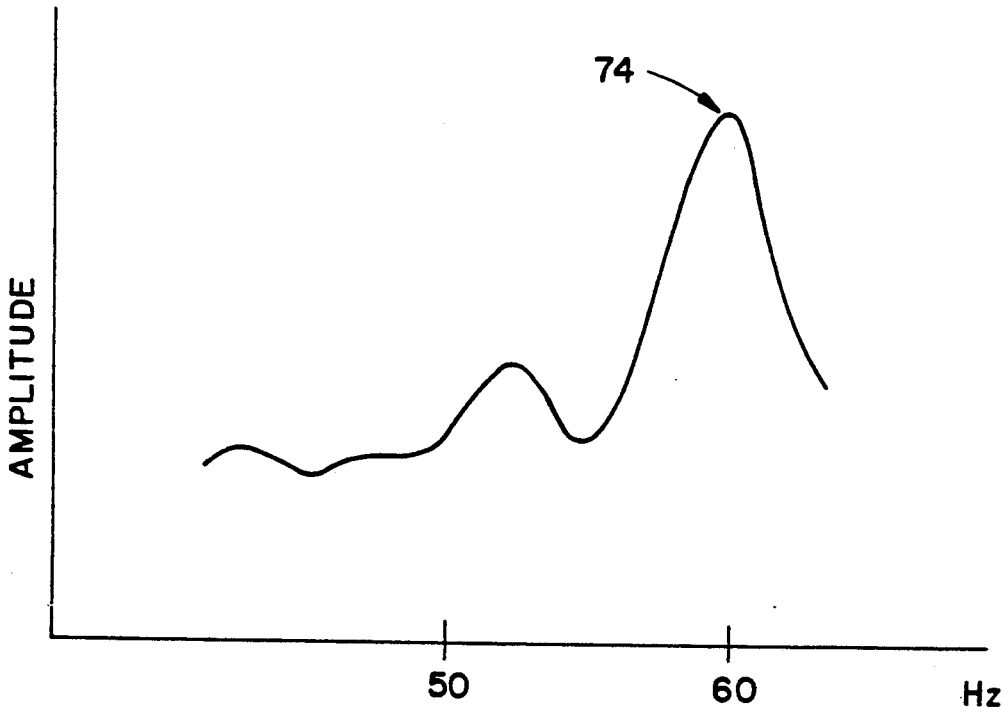
FIG. 4 is illustrative of typical resonant frequency peaks for a 4" anode.

With reference to FIG. 4, a typical vibration versus speed spectrum for a 4" anode is illustrated. It will be noted that the resonance has a peak 74 around 60 Hz but is much lower around 50 Hz and below. Accordingly, in the illustrated embodiment, it is advantageous to adjust the resistor 72 until the anode speed is dropped to 50 Hz or below.

Figure 5:
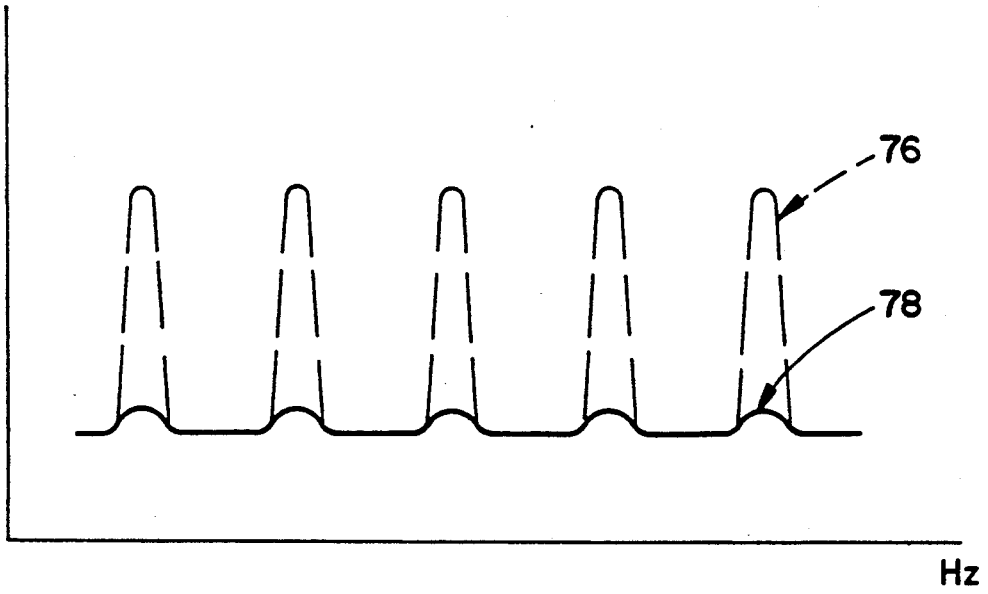
FIG. 5 illustrates the relative x-ray output spectrum generated by x-ray tubes with and without the circuit of FIG. 2.

When the anode is rotated, the resonance peak 74 of FIG. 4 causes the x-ray spectrum to vary as illustrated in curve 76 of FIG. 5. That is, periodic, large peaks occur in the x-ray output spectrum. When the rotation speed is reduced below 50 Hz and away from the resonance vibration peak, the x-ray output spectrum 78 becomes substantially more linear. The applicant has found a ten-fold reduction in the amount of spectrum peaks and a significantly extended bearing life.

Figure 6:
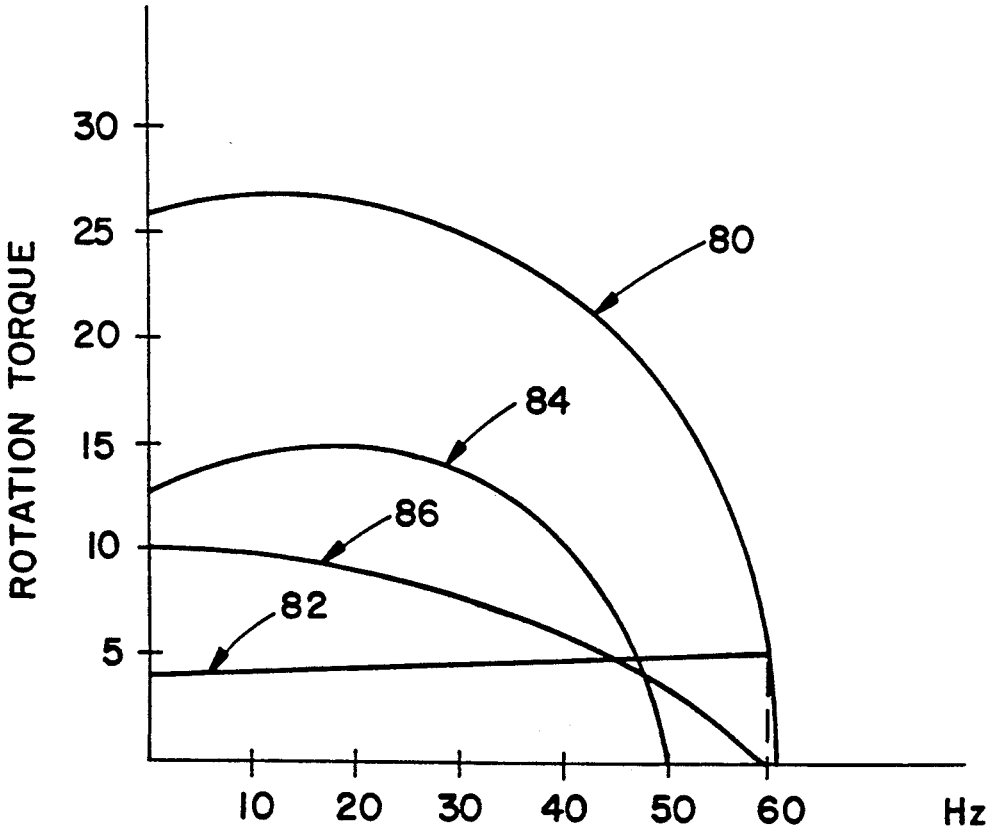
FIG. 6 is illustrative of effective drag.

With reference to FIG. 6, adjusting resistor 72 to zero resistance or replacing it with a short circuit would cause a speed versus rotation curve so. With illustrated bearing friction torque 82, the anode rotates at just under 60 Hz, i.e. very close to the resonance peak. Accordingly, the resistor 72 is adjusted, particularly increased, until a drag curve 84 is achieved producing an anode rotation speed of just under 50 Hz. Removing diode 70 and placing only resistor 72 in the circuit would cause rotation torque versus speed curve 86, a much less desireable torque curve because small variations in bearing friction cause large variations in rotational speed.

The invention has been described with reference to the preferred embodiments. Obviously, modifications and alterations will occur to others upon reading and understanding the preceding detailed description. It is intended that the invention be construed as including all such alterations and modifications insofar as they come within the scope of the appended claims or the equivalents thereof.

Having thus described the preferred embodiment, the invention is now claimed to be:

1. An x-ray diagnostic apparatus comprising:
an x-ray tube including a rotatably mounted anode and rotor combination and at least main and auxiliary stator windings electromagnetically coupled with the rotor;
an AC power source interconnected with the main and auxiliary windings for providing AC electrical power signals of the same frequency to the main and auxiliary windings of the stator with a phase lag between cycles of the AC electrical power supplied to the main and auxiliary windings;
a circuit connected between the AC source and one of the stator windings for cyclically applying a DC magnetic brake component during only a fractional portion of each cycle of the AC electrical power signal supplied to the one of the stator windings to shift a controlled steady state rotational speed of the anode and rotor combination;
an examination region disposed adjacent the x-ray tube such that x-rays from the x-ray tube generated while the anode is rotating at the controlled shifted steady state rotational speed irradiate a subject in the examination region;
an x-ray detecting means disposed opposite the subject receiving region from the x-ray tube for detecting radiation which has passed through the examination region.

2. The diagnostic apparatus as set forth in claim 1 wherein the circuit includes a parallel connected resistor and diode connected in series between the AC current source and the one stator winding.

3. An x-ray diagnostic apparatus comprising:
an x-ray tube including a rotatably mounted anode and rotor combination and at least main and auxiliary stator coil electromagnetically coupled with the rotor;
an AC power source interconnected with the main and auxiliary windings for supplying like, symmetric oscillating electric power signals to the main and auxiliary windings with a phase lag therebetween;
a means for creating a dissymmetry in the oscillating electric power signal supplied to one of the stator windings to create a drag which shifts a steady state rotational speed of the anode and rotor combination;
an examination region disposed adjacent the x-ray tube such that x-rays emanating from the anode rotating at the shifted steady state rotational speed irradiate a subject in the examination region;
an x-ray detecting means disposed opposite the subject receiving region from the x-ray tube for detecting radiation which has passed through the examination region.

4. A rotating anode x-ray tube assembly comprising:
an evacuated envelope;
a rotor rotatably mounted on bearings within the evacuated envelope;
an anode mounted within the evacuated envelope and connected with the rotor for rotation therewith;
a cathode for generating a beam of electrons which impinge upon the rotating anode in a focal spot to generate a beam of x-rays;

stator windings mounted outside of the envelope contiguous to the rotor and electromagnetically coupled therewith;

a means for attenuating first polarity half cycles in a supplied AC current which has alternating first and second polarity half cycles, the attenuating means being connected in series with one of the stator windings.

5. A rotating anode x-ray tube assembly comprising:

an evacuated envelope;

a rotor rotatably mounted on bearings within the evacuated envelope;

an anode mounted within the evacuated envelope and connected with the rotor for rotation therewith;

a cathode for generating a beam of electrons which impinge upon the rotating anode in a focal spot to generate a beam of x-rays;

stator windings mounted outside of the envelope contiguous to the rotor and electromagnetically coupled therewith;

a parallel connected resistor means and diode connected in series with one of the stator windings such that AC current supplied to the one stator winding through the parallel connected resistor means and diode is substantially unaffected when the diode is conducting and provides an effective DC magnetic braking force in an AC current cycle portion in which the diode is biased nonconductive.

6. The x-ray tube as set forth in claim 5 wherein the resistor means is adjustable such that the amount of DC magnetic braking is selectively adjustable.

7. A circuit for reducing a steady state rotation speed of a rotating anode x-ray tube, the circuit comprising:

a diode means connected between one of main and auxiliary stator windings and an AC source;

a resistor means connected in parallel with the diode means.

8. The circuit as set forth in claim 7, further including a conductor connected between a second stator winding and the current source for providing AC current thereto.

9. The circuit as set forth in claim 7, wherein the resistor means is adjustable.

10. A method of shifting a steady state rotational speed of an anode to a slower steady state rotational speed in an x-ray tube that includes stator windings electromagnetically coupled to a rotor associated with the anode, the method comprising:

supplying AC current with alternating first and second polarity half cycles to the stator windings;

attenuating only the first polarity half cycles of the AC current supplied to one of the stator windings.

* * * * *